US010217433B2

(12) United States Patent
Nakahara

(10) Patent No.: US 10,217,433 B2
(45) Date of Patent: Feb. 26, 2019

(54) DEVICE AND METHOD FOR DRIVING LIQUID CRYSTAL DISPLAY PANEL

(71) Applicant: Synaptics Japan GK, Tokyo (JP)

(72) Inventor: Michihiro Nakahara, Nara (JP)

(73) Assignee: Synaptics Japan GK, Tokyo (JP)

( * ) Notice: Subject to any disclaimer, the term of this patent is extended or adjusted under 35 U.S.C. 154(b) by 111 days.

(21) Appl. No.: 15/061,498

(22) Filed: Mar. 4, 2016

(65) Prior Publication Data

US 2016/0267861 A1 Sep. 15, 2016

(30) Foreign Application Priority Data

Mar. 13, 2015 (JP) ..... 2015-051399

(51) Int. Cl.
*G09G 3/36* (2006.01)

(52) U.S. Cl.
CPC ..... *G09G 3/3696* (2013.01); *G09G 3/3688* (2013.01); *G09G 2310/0248* (2013.01); *G09G 2310/0291* (2013.01); *G09G 2310/08* (2013.01); *G09G 2320/041* (2013.01)

(58) Field of Classification Search
CPC ..... G09G 2310/0248; G09G 2320/041; G09G 3/3685
USPC ..... 345/101, 106
See application file for complete search history.

(56) References Cited

U.S. PATENT DOCUMENTS

2005/0116902 A1* 6/2005 Miyzawa ..... G09G 3/325 345/76
2008/0278473 A1* 11/2008 An ..... H03K 19/00361 345/214
2008/0303771 A1 12/2008 Chen et al.
2009/0102780 A1* 4/2009 Brown ..... G09G 3/3648 345/101
2015/0009202 A1 1/2015 Cho et al.

FOREIGN PATENT DOCUMENTS

| | | | |
|---|---|---|---|
| JP | 2004219824 | A | 8/2004 |
| JP | 2005316459 | A | 11/2005 |
| JP | 2007011273 | A | 1/2007 |
| JP | 2007199203 | A | 8/2007 |
| JP | 2010102146 | A | 5/2010 |
| JP | 2012189765 | A | 10/2012 |
| JP | 2013228518 | A | 11/2013 |

* cited by examiner

*Primary Examiner* — Roy P Rabindranath
(74) *Attorney, Agent, or Firm* — Patterson + Sheridan, LLP

(57) ABSTRACT

A driver includes a temperature sensor, a drive circuitry configured to drive a source line of a liquid crystal display panel, and a precharge circuitry configured to perform a precharge operation of the source line. When a measured temperature by the temperature sensor is in a first temperature range, the precharge circuitry selectively performs the precharge operation of the source line in response to the grayscale level indicated by the image data. When the measured temperature is in a second temperature range lower than the first temperature range, the precharge circuitry performs a selected one of first and second operations. The first operation includes unconditionally performing the precharge operation of the source line independently of the grayscale level indicated by the image data, and the second operation includes unconditionally omitting the precharge operation of the source line independently of the grayscale level indicated by the image data.

8 Claims, 9 Drawing Sheets

[ROOM TEMPERATURE]

LARGE CHANGE IN BRIGHTNESS

[LOW TEMPERATURE]

A:EQUALIZATION TO GND
B:Hi-Z
C:PRECHARGE TO VCI

A:EQUALIZATION TO GND
B:Hi-Z
C:PRECHARGE TO VCL

DEVICE AND METHOD FOR DRIVING LIQUID CRYSTAL DISPLAY PANEL

CROSS REFERENCE

This application claims priority of Japanese Patent Application No. 2015-051399, filed on Mar. 13, 2015, the disclosure which is incorporated herein by reference.

TECHNICAL FIELD

The present invention relates to a liquid crystal display device, display driver and method for driving a liquid crystal display panel, more particularly, to control of drive operation for a liquid crystal display panel.

BACKGROUND ART

The requirements specification of a liquid crystal display device, which displays images on a liquid crystal display panel, may include assurance of wide temperature range operation, especially in on-board use, for example. To assure wide temperature range operation, it is desired to keep image quality at low temperature.

On the other hand, reducing power consumed by a liquid crystal display device may be desired. Reducing power consumption is important especially when a liquid crystal display device is incorporated in a system which uses a power storage device (e.g. battery) as the power supply.

One known approach for reducing power consumption in a liquid crystal display device is controlling the precharge operation of a source line in response to the value of image data (data indicating the grayscale level of each pixel). In this technique, execution/non-execution of the precharge operation is selected, most typically, in response to the value of the most significant bit of image data. When a 256-level grayscale is displayed on each pixel, for example, the precharge operation is not performed for image data indicating a grayscale level of "127" or less (in this case, the most significant bit of the image data is "0"), and the precharge operation is performed for image data indicating a grayscale level of "128" or more (in this case, the most significant bit of the image data is "1"). A technique in which the precharge level is controlled on the grayscale level indicated by image data is also known in the art; such technique is disclosed in Japanese Patent Application Publication No. 2010-102146 A.

According to an inventor's study, however, the control of the source line precharge operation in response to the grayscale level indicated in image data may cause display quality deterioration of a liquid crystal display device at low temperature.

SUMMARY OF INVENTION

One embodiment described herein is a driver adapted to drive a source line of a liquid crystal display panel. The driver includes a temperature sensor, a drive circuitry configured to drive the source line to a voltage corresponding to a grayscale level indicated by image data and a precharge circuitry configured to perform a precharge operation of the source line. When a measured temperature by the temperature sensor is in a first temperature range, the precharge circuitry selectively performs the precharge operation of the source line in response to the grayscale level indicated by the image data. When the measured temperature is in a second temperature range lower than the first temperature range, the precharge circuitry performs a selected one of first and second operations. The first operation includes unconditionally performing the precharge operation of the source line independently of the grayscale level indicated by the image data, and the second operation includes unconditionally omitting the precharge operation of the source line independently of the grayscale level indicated by the image data.

In another embodiment, a driver, which is adapted to drive a source line of a liquid crystal display panel, includes a temperature sensor, a drive circuitry configured to drive the source line in response to image data, a precharge circuitry configured to perform a precharge operation of the source line and an equalization circuitry configured to perform an equalization operation in which the source line is electrically connected to another source line of the liquid crystal display panel. When the measured temperature is in a first temperature range, the equalization circuitry performs the equalization operation in a first period of each horizontal sync period, the precharge circuitry performs the precharge operation of the source line in response to the grayscale level indicated by the image data in a second period of each horizontal sync period, the second period following the first period, and the drive circuitry drives the source line to the voltage corresponding to the grayscale level indicated by the image data in a third period of each horizontal sync period, the third period following the second period. When the measured temperature is in a second temperature range lower than the first temperature range, the equalization circuitry performs the equalization operation in the first period of each horizontal sync period, one of first and second operations selected in response to the grayscale level indicated by the image data is performed in the second period of each horizontal sync period, and the drive circuitry drives the source line to the voltage corresponding to the grayscale level indicated by the image data in the third period of each horizontal sync period. In the first operation, the precharge circuitry performs the precharge operation of the source line. In the second operation, the drive circuitry drives the source line to the voltage corresponding to the grayscale level indicated by the image data.

The drivers thus structured may be used in a liquid crystal display device.

Provided in still another embodiment is a method for driving a liquid crystal display panel of a liquid crystal display device including a temperature sensor. The method includes: performing a precharge operation of a source line of the liquid crystal display panel in response to a measured temperature by the temperature sensor; and driving the source line to a voltage corresponding to a grayscale level indicated by image data. The step of performing the precharge operation includes: performing the precharge operation of the source line in response to the grayscale level indicated by the image data when the measured temperature is in a first temperature range; and performing a selected one of first and second operations when the measured temperature is in a second temperature range lower than the first temperature range. The first operation includes unconditionally performing the precharge operation of the source line independently of the grayscale level indicated by the image data, and the second operation includes unconditionally omitting the precharge operation of the source line independently of the grayscale level indicated by the image data.

Provided in still another embodiment is another method for driving a liquid crystal display panel of a liquid crystal display device including a temperature sensor. This method includes: performing an equalization operation in which the source line is electrically connected to another source line of the liquid crystal display panel, in a first period of each horizontal sync period; selectively performing one of first and second operations in response to a measured temperature by the temperature sensor in a second period of each horizontal sync period, the second period following the first period; and driving the source line to the voltage corresponding to the grayscale level indicated by the image data in a third period of each horizontal sync period, third period following the second period. The first operation includes performing a precharge operation of the source line by the precharge circuitry in response to the grayscale level indicated by the image data, and the second operation includes driving the source line to the voltage corresponding to the grayscale level indicated by the image data by the drive circuitry. When the measured temperature is in a first temperature range, the precharge operation of the source line is performed in response to the grayscale level indicated by the image data when the measured temperature in the second period of each horizontal sync period. When the measured temperature is in a second temperature range lower than the first temperature range, one of the first and second operations selected in response to the grayscale level indicated by the image data is performed in the second period of each horizontal sync period.

The present invention effectively suppresses display quality deterioration of a liquid crystal display device at low temperature.

DESCRIPTION OF PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

For easy understanding of a technical concept embodied in the embodiments described below, a description is first given of a problem that may occur in the case when a control of the source line precharge operation is implemented in response to the grayscale level indicated in image data when driving a liquid crystal display panel.

One objective of the present disclosure is to suppress display quality deterioration of a liquid crystal display device at low temperature. Other objectives and new features of the present disclosure would be understood by a person skilled in the art from the following disclosure.

Figure 1:
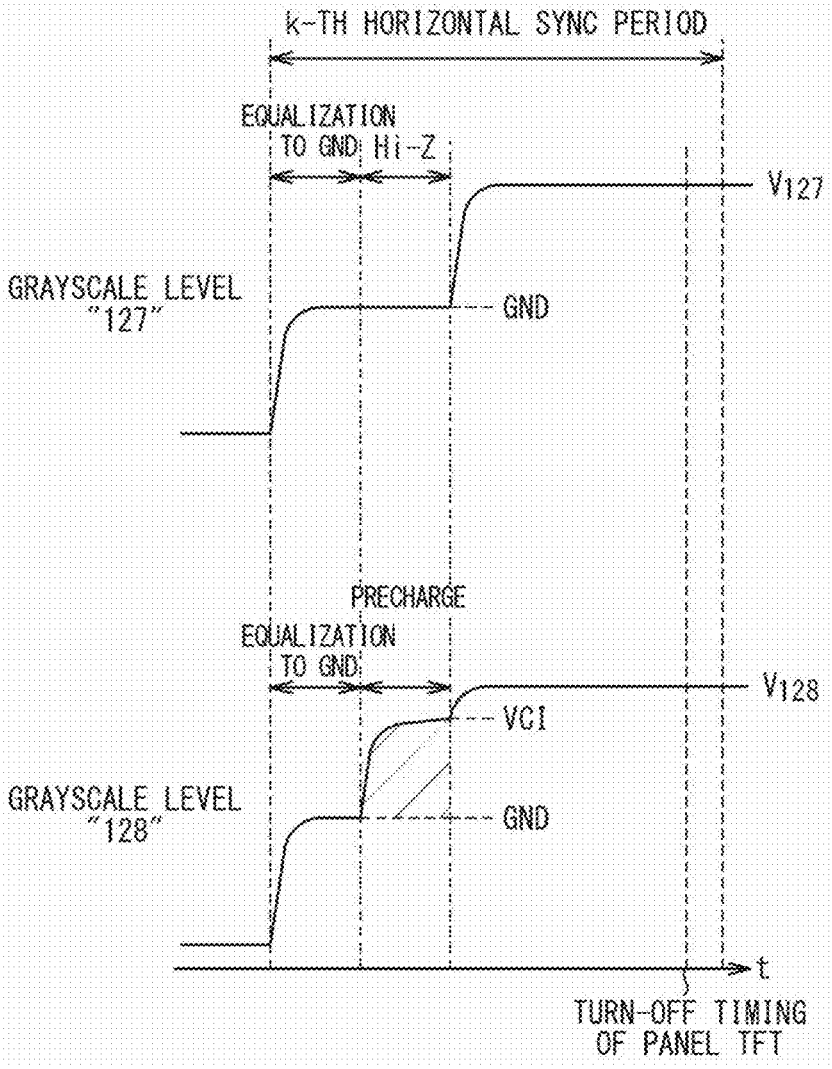
FIG. 1 is a timing chart illustrating one example of a drive operation of a source line in a certain horizontal sync period in the case that execution/non-execution of the precharge operation is selected in response to the value of the most significant bit of image data.

FIG. 1 is a timing chart illustrating one example of the source line drive operation in a certain horizontal sync period (hereinafter, referred to as k-th horizontal sync period) in the case that a control of the source line precharge operation is implemented in response to the grayscale level indicated in image data, more specifically, in the case that execution/non-execution of the precharge operation is selected in response to the value of the most significant bit of image data. Note that FIG. 1 illustrates the operation in the case that a source line that has been driven to a negative voltage in the immediately previous horizontal sync period (the (k−1)-th horizontal sync period) is driven to a positive voltage in the k-th horizontal sync period, and a 256-level grayscale is displayed on each pixel. In this case, image data associated with each pixel is 8-bit data and the most significant bit (MSB) of the image data is set to "0" for a grayscale level of 0 to 127 and "1" for a grayscale level of 128 to 255.

In the drive operation illustrated in FIG. 1, the precharge operation is not performed when the most significant bit of the image data is "0", whereas the precharge operation is performed when the most significant bit of the image data is "1". For example, the upper section of FIG. 1 illustrates the voltage waveform of the source line in the case that the grayscale level of a corresponding pixel is "127" in the k-th horizontal sync period, and the lower section illustrates the voltage waveform of the source line in the case that the grayscale level of the pixel is "128" in the k-th horizontal sync period.

For the drive operation in each horizontal sync period, three periods are defined: an equalization period, a precharge period and a drive period. The precharge period is defined to follow the equalization period and the drive period is defined to follow the precharge period. In the equalization period, the source lines are equalized. In one example, the source lines of the liquid crystal display panel are electrically connected to one another and set to the same potential level (for example, the circuit ground level). FIG. 1 illustrates the voltage waveform of a source line in the case that the source line is set to the circuit ground level GND in the source line equalization.

In the precharge period, which follows the equalization period, a precharge operation is performed in response to the most significant bit of image data. More specifically, the source line is precharged in the precharge period when the most significant bit of the image data is "1". In FIG. 1, the voltage waveform of the source line is illustrated with an assumption that the source line is precharged to a voltage VCI. The precharge operation is not performed in the precharge period, when the most significant bit of the image data is "0". In this case, the source line is set to high impedance (Hi-Z). The voltage on the source line basically remains unchanged when the source line is set to high impedance. Such operation allows selectively performing the precharge operation only when the source line is to be driven to a high voltage, and this effectively reduces the power consumption.

In the drive period, which follows the precharge period, the source line is driven to the voltage corresponding to the grayscale level. In FIG. 1, the voltage corresponding to a grayscale level of "127" is denoted by the legend "$V_{127}$" and the voltage corresponding to a grayscale level of "128" is denoted by the legend "$V_{128}$". Driving the source line with an output circuit having a sufficiently-large drive capacity enables driving the source line to the voltage corresponding to the grayscale level at a time sufficiently earlier than the turn-off timing of the TFT (thin film transistor) of the relevant pixel.

In the drive method illustrated in FIG. 1, the actually-perceived brightness of a pixel (the brightness of a pixel in an image actually displayed on the liquid crystal display panel) is determined by the voltage to which the associated source line is finally driven ($V_{127}$ or $V_{128}$ in the operation illustrated in FIG. 1) regardless of execution/non-execution of the precharge operation, when the liquid crystal has a sufficiently fast response speed. Accordingly, the pixel is driven so that there is a slight brightness difference corresponding to the difference of "1" in the grayscale level, between the case for the grayscale level of "127" and the case for the grayscale level of "128".

When the liquid crystal display device is operated at such a low temperature that the response speed of the liquid crystal is reduced, in contrast, the actually-perceived brightness of the pixel depends on the effective voltage on the associated source line (the time average of the voltage on the source line). As a result, the actually-perceived brightness of the pixel largely varies at the grayscale level at which the execution/non-execution of the precharge operation is switched. In the example illustrated in FIG. 1, for example, a large difference occurs in the actually-perceived brightness of the pixel between the cases for the grayscale levels of "127" and "128", when the liquid crystal display device is operated at a low temperature.

Figure 2:
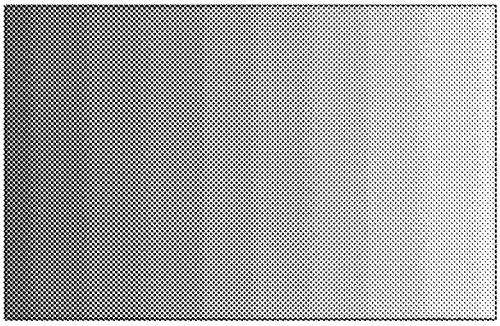
FIG. 2 illustrates an example of an actually-perceived image in the case that an image in which the grayscale levels incrementally vary from 0 to 255 in the left-to-right direction is displayed on a liquid crystal display panel.
Figure 2:
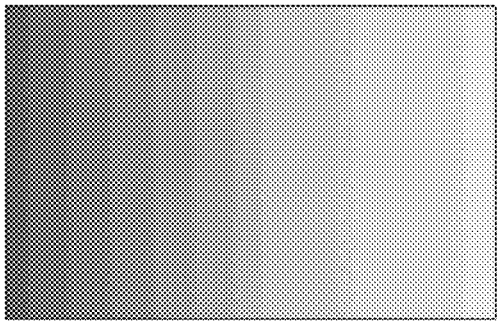

For example, FIG. 2 illustrates an example of an actually-perceived image in the case that an image in which the grayscale levels incrementally vary from 0 to 255 in the left-to-right direction is displayed on a liquid crystal display panel. When the liquid crystal display device is operated at a room temperature, an image in which the brightness smoothly varies in the left-to-right direction is displayed on the liquid crystal display device. When the liquid crystal display device is operated at a low temperature, in contrast, a large brightness difference is observed between the position at which the grayscale level is "127" and the position at which the grayscale level is "128" in the image actually displayed on the liquid crystal display panel.

This effect undesirably deteriorates the image quality when the liquid crystal display device is operated at a low temperature. In the embodiments described in the following, an approach is used which reduces the deterioration of the image quality of a liquid crystal display device at a low temperature.

Figure 3:
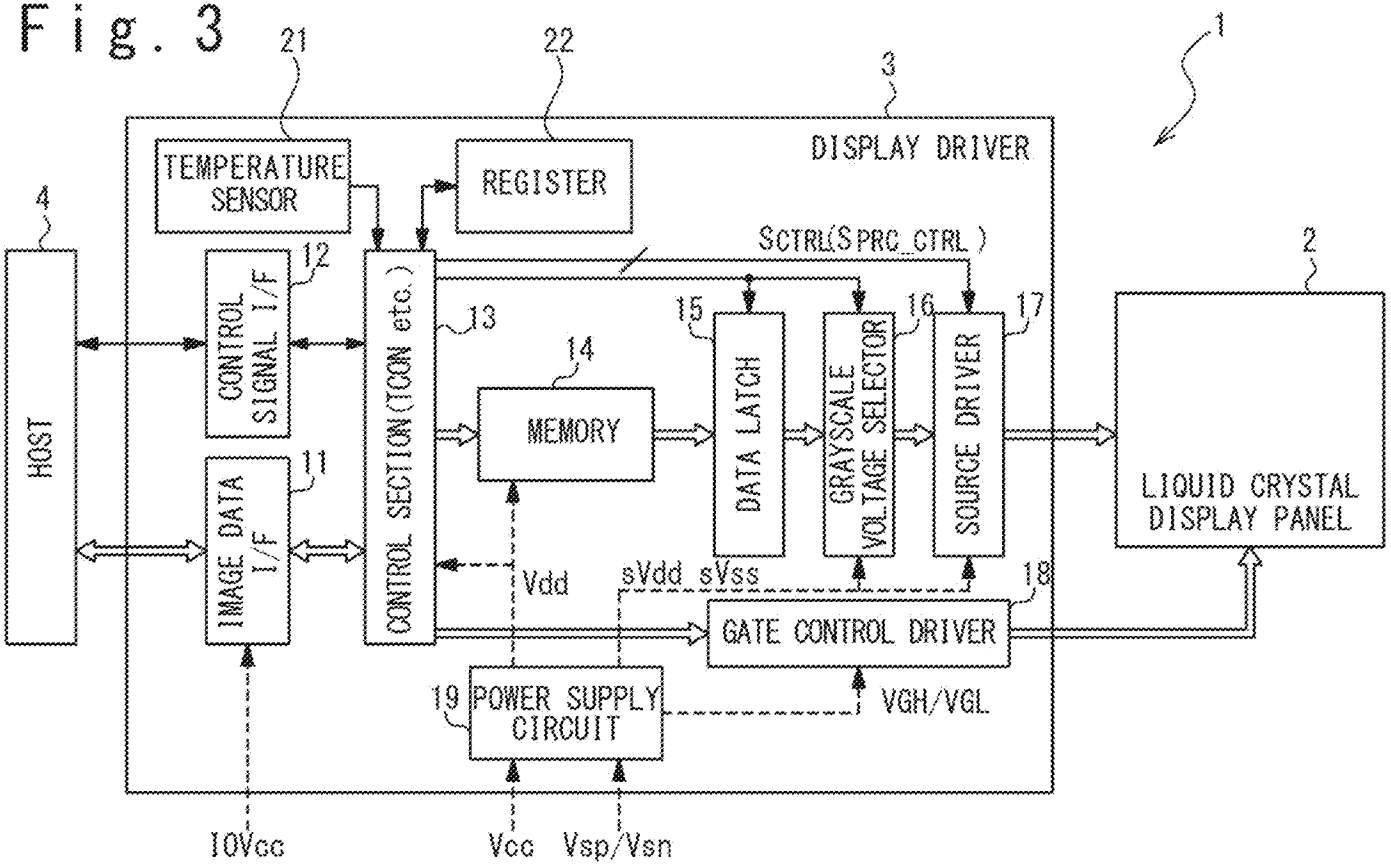
FIG. 3 is a block diagram illustrating an exemplary configuration of a liquid crystal display device in one embodiment of the present invention.

FIG. 3 is a block diagram illustrating an exemplary configuration of a liquid crystal display device 1 in one embodiment. The liquid crystal display device 1 includes a liquid crystal display panel 2 and a display driver 3. The liquid crystal display panel 2 includes a plurality of pixels arrayed in rows and columns, a plurality of gate lines and a plurality of source lines (note that the pixels, gate lines and source lines are not illustrated in FIG. 3). Each pixel is connected to an associated gate line and source line. The display driver 3 drives the liquid crystal display panel 2 in response to image data and control signals received from the host 4.

The display driver 3 includes: an image data interface 11, a control signal interface 12, a control section 13, a memory 14, a data latch 15, a grayscale voltage selector circuit 16, a source driver circuit 17, a gate control driver 18, a power supply circuit 19, a temperature sensor 21 and a register 22.

The image data interface 11 transfers the image data received from the host 4 to the control section 13 and the control signal interface 12 feeds to the control section 13 various control data (e.g. control commands and control parameters) generated from the control signals received from the host 4.

The control section 13 controls respective circuits integrated in the display driver 3 in response to the control data received from the control signal interface 12. In detail, the control section 13 includes a timing controller to achieve timing control of the respective circuits integrated in the display driver 3. As described later, the control section 13 also has the function of controlling the operation of the source driver circuit 17, especially the precharge operation of the source lines; the control section 13 generates a series of source driver control signals $S_{CTRL}$ which are used to control the operation of the source driver circuit 17. The series of source driver control signals $S_{CTRL}$ include a precharge control signal $S_{PRE_CTRL}$, which controls the precharge operation. The control section 13 further has the function of transferring the image data received from the image data interface 11, to the memory 14.

The memory 14, the data latch 15, the grayscale voltage selector circuit 16 and the source driver circuit 17 form a drive circuitry which drives the respective source lines of the liquid crystal display panel 2 in response to the image data received from the control section 13. In detail, the memory 14 temporarily stores therein the image data received from the control section 13. In one embodiment, the memory 14 is configured to store image data for one frame image. The data latch 15 latches the image data received from the memory 14 and transfers the latched image data to the grayscale voltage selector circuit 16. In one embodiment, the data latch 15 is configured to latch image data corresponding to pixels of one horizontal line of the liquid crystal display panel 2 (that is, pixels connected to one gate line) at the same time. The grayscale voltage selector circuit 16 selects grayscale voltages corresponding to the image data received from the data latch 15 and feeds the selected grayscale voltages to the source driver circuit 17. The source driver circuit 17 receives the grayscale voltages associated with the respective source lines of the liquid crystal display panel 2 from the grayscale voltage selector circuit 16. The source driver circuit 17 drivers the respective source lines of the liquid crystal display panel 2 to the voltages corresponding to the grayscale voltages received from the grayscale voltage selector circuit 16.

The gate control driver 18 drives the gate lines of the liquid crystal display panel 2. Alternatively, in the case that the liquid crystal display panel 2 integrates therein a gate driver circuit that drives the gate lines (such a gate driver circuit is often referred to as a GIP (gate-in-panel) circuit), the gate control driver 18 may feed to the liquid crystal display panel 2 a set of control signals which control the gate driver circuit.

The power supply circuit 19 generates various power supply voltages used for the operations of the respective circuits integrated in the display driver 3, from a power supply voltage Vcc and a pair of analog power supply voltages Vsp and Vsn, which are externally fed to the power supply circuit 19. In one embodiment, the power supply circuit 19 feeds to the control section 13 and the memory 14 a logic power supply voltage Vdd generated from the power supply voltage Vcc. The power supply circuit 19 also feeds to the grayscale voltage selector circuit 16 and the source driver circuit 17 a pair of analog power supply voltages sVdd and sVss which are generated from the analog power supply voltages Vsp and Vsn, and further feeds to the gate control driver 18 a gate high voltage VGH and gate low voltage VGL which are generated from the analog power supply voltages Vsp and Vsn.

The temperature sensor 21 and the register 22 feeds to the control section 13 information used for the precharge operation control performed by the control section 13. In detail, the temperature sensor 21 functions as a temperature measurement means configured to generate temperature data corresponding to the temperature of the temperature sensor 21 and feed the temperature data to the control section 13. The temperature sensor 21 may include a semiconductor circuit having temperature-dependent characteristics. Since the temperature sensor 21 has a temperature close to the atmosphere temperature of the liquid crystal display device 1 or the temperature of the liquid crystal display panel 2, the temperature data generated by the temperature sensor 21 indicates a value corresponding to the atmosphere temperature of the liquid crystal display device 1 or the temperature of the liquid crystal display panel 2.

The register 22 stores therein precharge control data used for the precharge operation control performed by the control section 13. The precharge control data specify a precharge operation to be performed in each temperature range. The contents of the precharge control data and the precharge operation control based on the precharge control data are described later in detail. The register 22 may be used also for storing control parameters other than the precharge control data.

Figure 4:
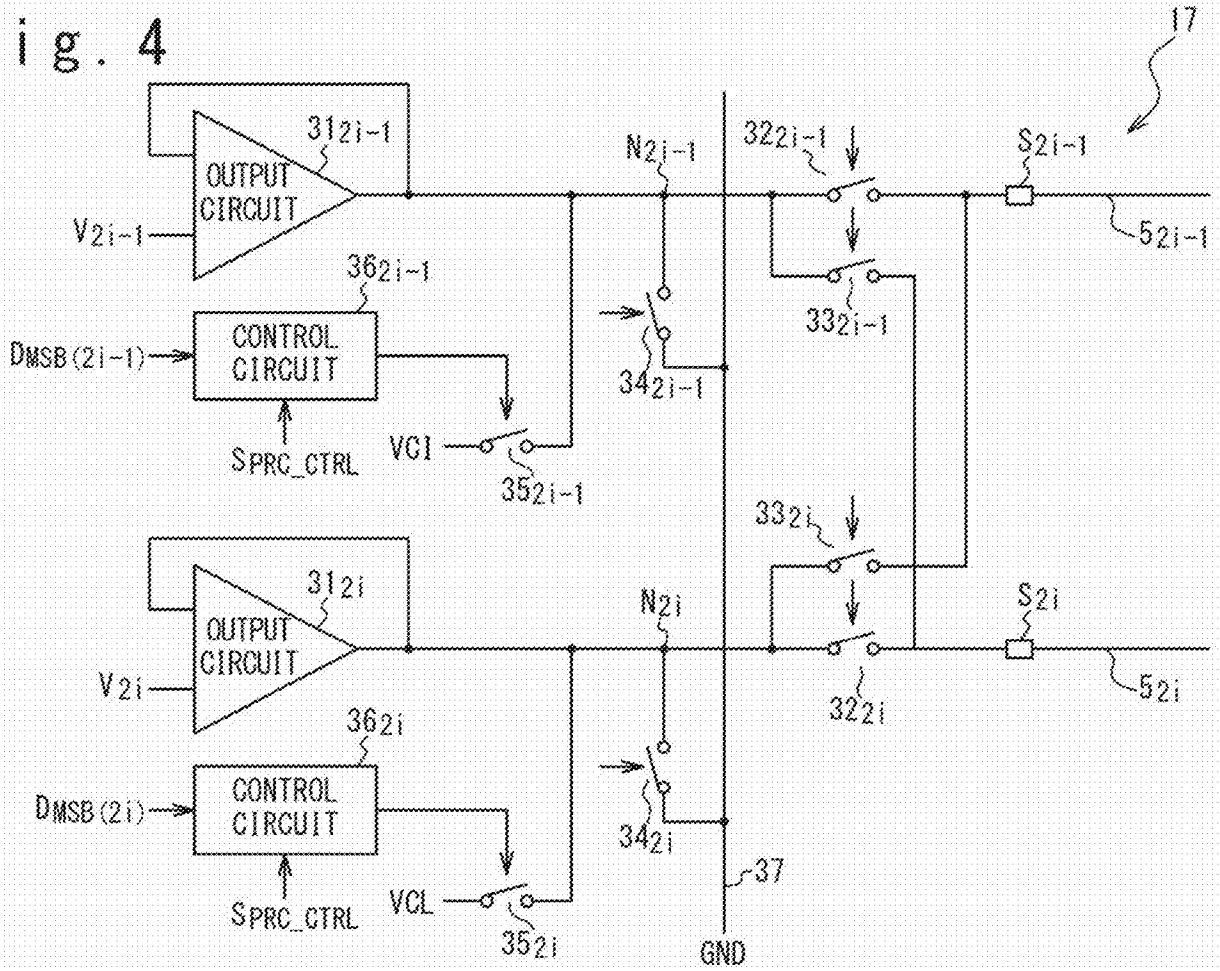
FIG. 4 is a circuit diagram illustrating one example of the configuration of a source driver circuit in the present embodiment.

FIG. 4 is a circuit diagram illustrating one example of the configuration of the source driver circuit 17, more specifically, the configuration of a drive section that drives an odd-numbered source output $S_{2i-1}$ and an even-numbered source output $S_{2i}$ adjacent thereto, in the source driver circuit 17. The source outputs $S_{2i-1}$ and $S_{2i}$ are connected to source lines $\mathbf{5}_{2i-1}$ and $\mathbf{5}_{2i}$ of the liquid crystal display panel 2, respectively. This implies that the drive section drives the source lines $\mathbf{5}_{2i-1}$ and $\mathbf{5}_{2i}$ via the source outputs $S_{2i-1}$ and $S_{2i}$.

The drive section of the source driver circuit 17 illustrated in FIG. 4 is configured to drive two pixels adjacent in the horizontal direction (the direction in which the gate lines are extended) with voltages of opposite polarities. In other words, the drive section of the source driver circuit 17 drives one of the source outputs $S_{2i-1}$ and $S_{2i}$ to a positive voltage and the other to a negative voltage. This configuration is especially preferable for achieving a dot inversion drive. In the following, a detailed description is given of the configuration of the source driver circuit 17 illustrated in FIG. 4.

The source driver circuit 17 includes: output circuits $\mathbf{31}_{2i-1}$, $\mathbf{31}_{2i}$, straight switches $\mathbf{32}_{2i-1}$, $\mathbf{32}_{2i}$, cross switches $\mathbf{33}_{2i-1}$, $\mathbf{33}_{2i}$, equalizing switches $\mathbf{34}_{2i-1}$, $\mathbf{34}_{2i}$, precharge switches $\mathbf{35}_{2i-1}$, $\mathbf{35}_{2i}$ and control circuits $\mathbf{36}_{2i-1}$ and $\mathbf{36}_{2i}$.

The output circuit $\mathbf{31}_{2i-1}$ outputs a voltage corresponding to the grayscale voltage $V_{2i-1}$ received from the grayscale voltage selector circuit 16 (most typically, the same voltage as the grayscale voltage $V_{2i-1}$), and the output circuit $\mathbf{31}_{2i}$ outputs a voltage corresponding to the grayscale voltage $V_{2i}$ received from the grayscale voltage selector circuit 16 (most typically, the same voltage as the grayscale voltage $V_{2i}$). The output of the output circuit $\mathbf{31}_{2i-1}$ is connected to a node $N_{2i-1}$ and the output of the output circuit $\mathbf{31}_{2i}$ is connected to a node $N_{2i}$.

The output circuit $\mathbf{31}_{2i-1}$ is configured to output a positive voltage and the output circuit $\mathbf{31}_{2i}$ is configured to output a negative voltage. Note that the grayscale voltage selector circuit 16 selects the grayscale voltages $V_{2i-1}$ and $V_{2i}$ so that the grayscale voltage $V_{2i-1}$ corresponds to a positive voltage to which one of the source lines $\mathbf{5}_{2i-1}$ and $\mathbf{5}_{2i}$, which are connected to the source outputs $S_{2i-1}$ and $S_{2i}$, is to be driven, and the grayscale voltage $V_{2i}$ corresponds to a negative voltage to which the other of the source lines $\mathbf{5}_{2i-1}$ and $\mathbf{5}_{2i}$ is to be driven.

The straight switches $\mathbf{32}_{2i-1}$, $\mathbf{32}_{2i}$ and the cross switches $\mathbf{33}_{2i-1}$ and $\mathbf{33}_{2i}$ form a switch circuitry configured to switch connections among the nodes $N_{2i-1}$, $N_{2i}$ and the source outputs $S_{2i-1}$ and $S_{2i}$. In detail, the straight switches $\mathbf{32}_{2i-1}$ is connected between the node $N_{2i-1}$ and the source output $S_{2i-1}$ and the straight switches $\mathbf{32}_{2i}$ is connected between the node $N_{2i}$ and the source output $S_{2i}$. The straight switches $\mathbf{32}_{2i-1}$ and $\mathbf{32}_{2i}$ are turned on when the source line $\mathbf{5}_{2i-1}$ (and the source output $S_{2i-1}$ connected thereto) is to be driven to a positive voltage and the source line $\mathbf{5}_{2i}$ (and the source output $S_{2i}$ connected thereto) is to be driven to a negative voltage.

Meanwhile, the cross switch $\mathbf{33}_{2i-1}$ is connected between the node $N_{2i-1}$ and the source output $S_{2i}$ and the cross switch $\mathbf{33}_{2i}$ is connected between the node $N_{2i}$ and the source output $S_{2i-1}$. The cross switches $\mathbf{33}_{2i-1}$ and $\mathbf{33}_{2i}$ are turned on when the source line $\mathbf{5}_{2i-1}$ (and the source output $S_{2i-1}$ connected thereto) is to be driven to a negative voltage and the source line $\mathbf{5}_{2i}$ (and the source output $S_{2i}$ connected thereto) is to be driven to a positive voltage.

The equalizing switch $\mathbf{34}_{2i-1}$ is connected between the node $N_{2i-1}$ and a circuit ground line 37 and the equalizing switch $\mathbf{34}_{2i}$ is connected between the node $N_{2i}$ and the circuit ground line 37. The equalizing switches $\mathbf{34}_{2i-1}$ and $\mathbf{34}_{2i}$, which form an equalization circuitry which performs equalization of the source lines $\mathbf{5}_{2i-1}$ and $\mathbf{5}_{2i}$, are turned on when the equalization of the source lines $\mathbf{5}_{2i-1}$ and $\mathbf{5}_{2i}$ are performed. It should be noted that, in the present embodiment, the straight switches $\mathbf{32}_{2i-1}$, $\mathbf{32}_{2i}$ and/or the cross switches $\mathbf{33}_{2i-1}$ and $\mathbf{33}_{2i}$ are also turned on when the equalization of the source lines $\mathbf{5}_{2i-1}$ and $\mathbf{5}_{2i}$ are performed.

The precharge switches $\mathbf{35}_{2i-1}$, $\mathbf{35}_{2i}$ and the control circuits $\mathbf{36}_{2i-1}$ and $\mathbf{36}_{2i}$ form a precharge circuitry which precharges the source lines $\mathbf{5}_{2i-1}$ and $\mathbf{5}_{2i}$.

In detail, the precharge switch $\mathbf{35}_{2i-1}$ is connected between the node $N_{2i-1}$ and a node fed with a voltage VCI, and the precharge switch $\mathbf{35}_{2i}$ is connected between the node $N_{2i}$ and a node fed with a voltage VCL, where the voltage VCI is a predetermined positive voltage and the voltage VCL is a predetermined negative voltage. The precharge switch $\mathbf{35}_{2i-1}$ is turned on when one of the source lines $\mathbf{5}_{2i-1}$ and $\mathbf{5}_{2i}$ which is to be driven to a positive voltage is precharged to the voltage VCI, and the precharge switch $\mathbf{35}_{2i}$ is turned on when the other of the source lines $\mathbf{5}_{2i-1}$ and $\mathbf{5}_{2i}$, which is to be driven to a negative voltage, is precharged to the voltage VCL.

The control circuit $\mathbf{36}_{2i-1}$ controls the precharge switch $\mathbf{35}_{2i-1}$ and the control circuit $\mathbf{36}_{2i}$ controls the precharge switch $\mathbf{35}_{2i}$. In the present embodiment, the control circuit $\mathbf{36}_{2i-1}$ controls the precharge switch $\mathbf{35}_{2i-1}$ in response to the precharge control signal $S_{PRC_CTRL}$ received from the control section 13 and the most significant bit $D_{MSB(2i-1)}$ of the image data $D_{2i-1}$ corresponding to the grayscale voltage $V_{2i-1}$. Similarly, the control circuit $36_{2i}$ controls the precharge switch $35_{2i}$ in response to the precharge control signal $S_{PRC_CTRL}$ received from the control section 13 and the most significant bit $D_{MSB(2i)}$ of the image data $D_{2i}$ corresponding to the grayscale voltage $V_{2i}$. In the present embodiment, as described later in detail, the precharge control signal $S_{PRC_CTRL}$ is generated in response to the temperature data generated by the temperature sensor 21, and thereby the execution/non-execution of the precharge operation is controlled in response to the temperature measured by the temperature sensor 21 (which may be simply referred to as the measured temperature, hereinafter).

Figure 5A:
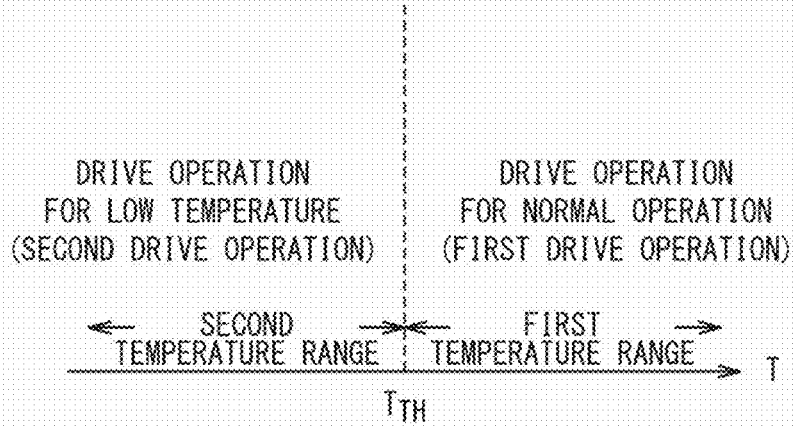
FIG. 5A is a conceptual diagram illustrating one example of the drive operation of a liquid crystal display panel in the present embodiment.

FIG. 5A is a conceptual diagram illustrating one example of the drive operation of the liquid crystal display panel 2 in the present embodiment. In the present embodiment, a drive operation different from the normal operation is performed when the liquid crystal display device 1 is operated at low temperature. More specifically, a normal drive operation (a first drive operation) is performed when the measured temperature by the temperature sensor 21 is in a first temperature range which is higher than a predetermined threshold temperature $T_{TH}$, and a low temperature drive operation (a second drive operation) is performed when the measured temperature by the temperature sensor 21 is in a second temperature range which is lower than a predetermined threshold temperature $T_{TH}$. The threshold temperature $T_{TH}$ may be specified in the precharge control data set to the register 22.

In the normal drive operation, the source line precharge operation is controlled in response to the grayscale levels indicated by the image data. More particularly, Execution/non-execution of the precharge operation is selected in response to the most significant bit of the image data in the normal drive operation. This operation effectively reduces the power consumption.

In the low temperature drive operation, in contrast, the precharge operation of the source lines is controlled independently of the grayscale levels indicated by the image data. In one embodiment, the precharge operation may be omitted in the low temperature drive operation, independently of the grayscale levels indicated by the image data (that is, independently of the most significant bits of the image data). In an alternative embodiment, the precharge operation may be unconditionally performed in the low temperature drive operation, independently of the grayscale levels indicated by the image data (that is, independently of the most significant bits of the image data). When the precharge operation of the source lines is controlled independently of the grayscale levels indicated by the image data, this effectively resolves the problem that the actually-perceived brightness of a pixel largely varies at the grayscale level at which execution/non-execution of the precharge operation is switched. For example, when the precharge operation is omitted independently of the grayscale levels indicated by the image data in the low temperature drive operation, this effectively resolves the problem that the actually-perceived brightness of a pixel largely varies at the grayscale level at which execution/non-execution of the precharge operation is switched.

The low temperature drive operation may be switched among a plurality of drive operations by modifying the precharge control data set in the register 22. For example, the low temperature drive operation may be modified by writing precharge control data specifying a desired drive operation into the register 22 from the host 4.

When the drive operation is switched in response to whether or not the measured temperature by the temperature sensor 21 is higher than the predetermined threshold temperature $T_{TH}$, as illustrated in FIG. 5A, the switching between the normal drive operation and the low temperature drive operation may occur frequently, when the measured temperature by the temperature sensor 21 is close to the threshold temperature $T_{TH}$. To avoid this problem, the drive operation may be switched with a hysteresis behavior.

Figure 5B:
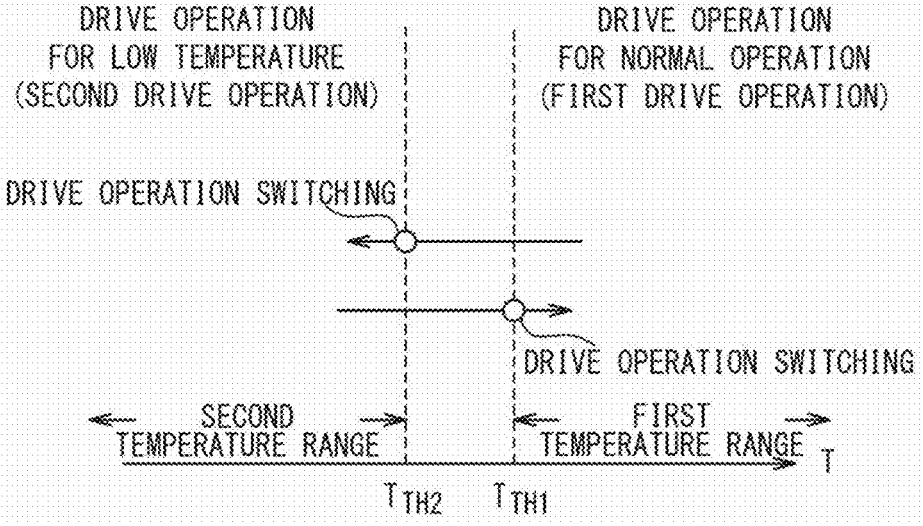
FIG. 5B is a conceptual diagram illustrating another example of the drive operation of a liquid crystal display panel in the present embodiment.

FIG. 5B is a conceptual diagram illustrating the drive operation of the liquid crystal display panel 2 in the case that the drive operation is switched with a hysteresis behavior. More particularly, when the measured temperature by the temperature sensor 21 is higher than a first threshold temperature $T_{TH1}$, the normal drive operation is performed. In the normal drive operation, as described above, the source line precharge operation is controlled in response to the grayscale levels indicated by the image data. More specifically, execution/non-execution of the precharge operation is selected in response to the most significant bit of the image data in the normal drive operation.

When the temperature measured by the temperature sensor 21 becomes lower than a second threshold temperature $T_{TH2}$ which is lower than the first threshold temperature $T_{TH1}$ in the normal drive operation, the drive operation of the liquid crystal display panel 2 is switched to the low temperature drive operation. As described above, the precharge operation of the source lines is controlled independently of the grayscale levels indicated by the image data in the low temperature drive operation. When the temperature measured by the temperature sensor 21 becomes higher than the first threshold temperature $T_{TH1}$ in the low temperature drive operation, on the other hand, the drive operation of the liquid crystal display panel 2 is switched to the normal drive operation. The first and second threshold temperatures $T_{TH1}$ and $T_{TH2}$ may be specified in the precharge control data set to the register 22.

In this operation, the normal drive operation is performed when the measured temperature by the temperature sensor 21 is in a first temperature range higher than the first threshold temperature $T_{TH1}$, and the low temperature drive operation is performed when the measured temperature by the temperature sensor 21 is in a second temperature range lower than the second threshold temperature $T_{TH2}$. When the measured temperature by the temperature sensor 21 is in the range between the first and second threshold temperatures $T_{TH1}$ and $T_{TH2}$, a selected one of the normal drive operation and the low temperature drive operation is performed depending on the changes in the measured temperature by the temperature sensor 21 in the past.

It should be noted that the normal drive operation is performed in the first temperature range and the low temperature drive operation is performed in the second temperature range, which is lower than the first temperature range, in both of the drive operations illustrated in FIGS. 5A and 5B.

As described above, in the present embodiment, the precharge operation of the source lines is controlled independently of the grayscale levels indicated by the image data in the low temperature drive operation; it should be noted however that the low temperature drive operation may be variously modified. In the following, a description is given of various embodiments of the drive method of the liquid crystal display panel, more particularly, various examples of the low temperature drive operation. In the examples described in the following, it is assumed that 256-level grayscale is displayed on each pixel. In this case, image data associated with each pixel are 8-bit data; the most significant bit of image data is set to "0" when the grayscale level indicated by the image data is 0 to 127, and set to "1" when the grayscale level indicated by the image data is 128 to 255.

Embodiment #1

Figure 6A:
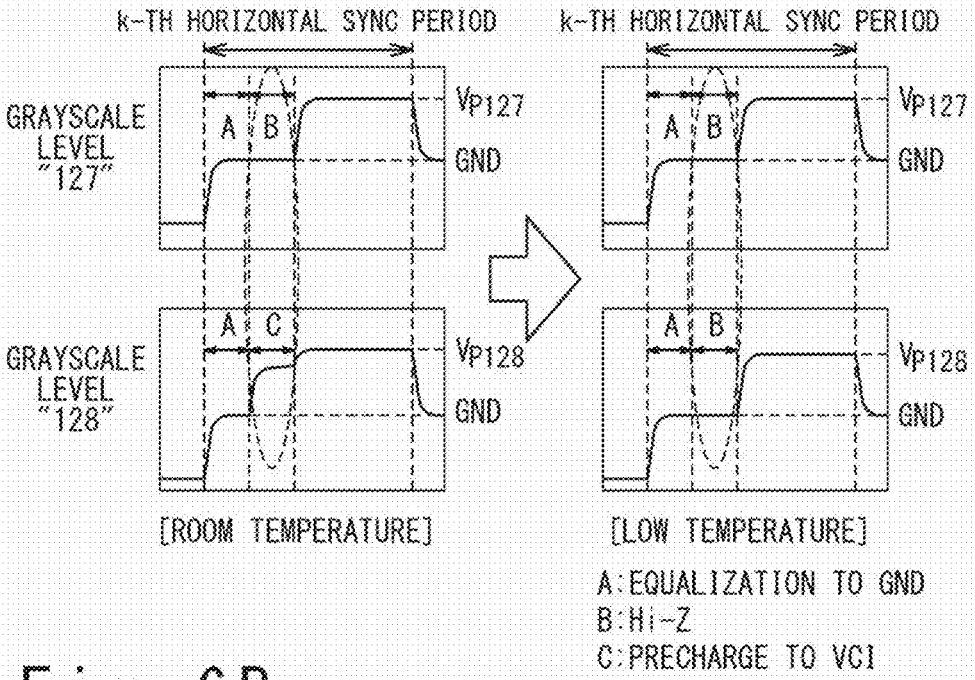
FIGS. 6A and 6B are timing charts illustrating a source line drive operation in embodiment #1.
Figure 6B:
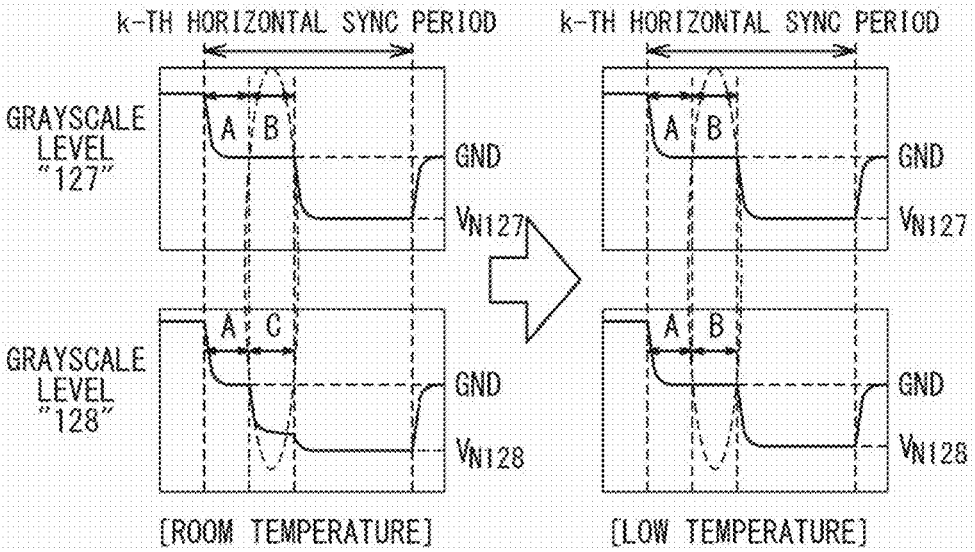

FIGS. 6A and 6B are timing charts illustrating one example of the drive operation of the source lines in the k-th horizontal sync period in embodiment #1. Note that FIG. 6A illustrates an exemplary operation in the case that a source line which has been driven to a negative voltage in the immediately previous horizontal sync period ((k−1)-th horizontal sync period) is driven to a positive voltage in the k-th horizontal sync period, and FIG. 6B illustrates an exemplary operation in the case that a source line which has been driven to a positive voltage in the immediately previous horizontal sync period ((k−1)-th horizontal sync period) is driven to a negative voltage in the k-th horizontal sync period. With respect to the source driver circuit 17 illustrated in FIG. 4, for example, the voltage waveforms on the source lines $\mathbf{5}_{2i-1}$ and $\mathbf{5}_{2i}$ are illustrated in FIGS. 6A and 6B, respectively, for the case that the source lines $\mathbf{5}_{2i-1}$ and $\mathbf{5}_{2i}$ are driven to positive and negative drive voltages in the k-th horizontal sync period, respectively. For the case that the source lines $\mathbf{5}_{2i-1}$ and $\mathbf{5}_{2i}$ are driven to negative and positive drive voltages in the k-th horizontal sync period, respectively, on the other hand, the voltage waveforms on the source lines $\mathbf{5}_{2i-1}$ and $\mathbf{5}_{2i}$ are illustrated in FIGS. 6B and 6A, respectively.

When a room temperature is measured by the temperature sensor 21, the normal drive operation is performed. More specifically, in the drive operation illustrated in FIG. 5A, for example, the normal drive operation is performed when the measured temperature by the temperature sensor 21 is higher than the threshold temperature $T_{TH}$. In the drive operation illustrated in FIG. 5B, on the other hand, the normal drive operation is performed when the liquid crystal display device 1 is switched from the state in which the measured temperature by the temperature sensor 21 is lower than the first threshold temperature $T_{TH1}$ to the state in which the measured temperature by the temperature sensor 21 is higher than the first threshold temperature $T_{TH1}$, or when the measured temperature by the temperature sensor 21 is continuously kept higher than the first threshold temperature $T_{TH1}$.

When a low temperature is measured by the temperature sensor 21, the low temperature drive operation is performed. More specifically, in the drive operation illustrated in FIG. 5A, for example, the low temperature drive operation is performed when the measured temperature by the temperature sensor 21 is lower than the threshold temperature $T_{TH}$. In the drive operation illustrated in FIG. 5B, on the other hand, the low temperature drive operation is performed when the liquid crystal display device 1 is switched from the state in which the measured temperature by the temperature sensor 21 is higher than the second threshold temperature $T_{TH2}$ to the state in which the measured temperature by the temperature sensor 21 is lower than the second threshold temperature $T_{TH2}$, or when the measured temperature by the temperature sensor 21 is continuously kept lower than the second threshold temperature $T_{TH2}$. In the following, a description is given of exemplary operations of the liquid crystal display device 1 in the normal drive operation and the low temperature drive operation, respectively.

(1) Normal Drive Operation

The left columns of FIGS. 6A and 6B are timing charts illustrating the operation of the liquid crystal display device 1 in the k-th horizontal sync period in embodiment #1 in the case that the normal drive operation is performed.

When the source line $\mathbf{5}_{2i-1}$ is driven to a positive drive voltage and the source line $\mathbf{5}_{2i}$ is driven to a negative drive voltage in the k-th horizontal sync period, the straight switches $\mathbf{32}_{2i-1}$ and $\mathbf{32}_{2i}$ are turned on to electrically connect the source lines $\mathbf{5}_{2i-1}$ and $\mathbf{5}_{2i}$ to the nodes $N_{2i-1}$ and $N_{2i}$, respectively, in the k-th horizontal sync period. When the source line $\mathbf{5}_{2i-1}$ is driven to a negative drive voltage and the source line $\mathbf{5}_{2i}$ is driven to a positive drive voltage in the k-th horizontal sync period, on the other hand, the cross switches $\mathbf{33}_{2i-1}$ and $\mathbf{33}_{2i}$ are turned on to electrically connect the source lines $\mathbf{5}_{2i-1}$ and $\mathbf{5}_{2i}$ to the nodes $N_{2i}$ and $N_{2i-1}$, respectively, in the k-th horizontal sync period.

When the normal drive operation is performed, the precharge control signal $S_{PRC_CTRL}$ is asserted by the control section 13 in the source driver circuit 17 illustrated in FIG. 4. When the precharge control signal $S_{PRC_CTRL}$ is asserted, the control circuit $\mathbf{36}_{2i-1}$ is placed into the state in which the control circuit $\mathbf{36}_{2i-1}$ controls the precharge switch $\mathbf{35}_{2i-1}$ in response to the most significant bit $D_{MSB(2i-1)}$ of the image data $D_{2i-1}$, and the control circuit $\mathbf{36}_{2i}$ is placed into the state in which the control circuit $\mathbf{36}_{2i}$ controls the precharge switch $\mathbf{35}_{2i}$ in response to the most significant bit $D_{MSB(2i)}$ of the image data $D_{2i}$.

When the normal drive operation is performed in the k-th horizontal sync period, three periods are defined in the k-th horizontal sync period: an equalization period, a precharge period, and a drive period. The precharge period is defined to follow the equalization period and the drive period is defined to follow the precharge period.

In the equalization period, equalization of the source lines is performed. More specifically, the equalizing switches $\mathbf{34}_{2i-1}$ and $\mathbf{34}_{2i}$ are turned on to connect the nodes $N_{2i-1}$ and $N_{2i}$ to the circuit ground line 37, and the outputs of the output circuits $\mathbf{31}_{2i-1}$ and $\mathbf{31}_{2i}$ are placed into the high impedance (Hi-Z) state. This results in that the source lines $\mathbf{5}_{2i-1}$ and $\mathbf{5}_{2i}$ are electrically connected to the circuit ground line 37, and thereby equalized to the circuit ground level. FIGS. 6A and 6B illustrate the voltage waveforms of the source lines when the source lines are set to the circuit ground level GND. In FIGS. 6A and 6B, the legends "A" denote the operation in which the source lines are equalized to the circuit ground level GND.

In the precharge period, which follows the equalization period, the precharge operation is performed in response to the grayscale levels indicated by the image data, more particularly, to the most significant bit of the image data associated with each pixel. More specifically, the operation descried below is performed in the precharge period.

The control circuit $\mathbf{36}_{2i-1}$ turns off the precharge switch $\mathbf{35}_{2i-1}$ when the most significant bit of the image data $D_{2i-1}$ is "0" and turns on the precharge switch $\mathbf{35}_{2i-1}$ when the most significant bit of the image data $D_{2i-1}$ is "1". This results in that, as illustrated in FIG. 6A, the source line to be driven to a positive drive voltage selected from the source lines $\mathbf{5}_{2i-1}$ and $\mathbf{5}_{2i}$ is placed into the high impedance state when the most significant bit of the image data $D_{2i-1}$ is "0" and precharged to the voltage VCI when the most significant bit of the image data $D_{2i-1}$ is "1."

The upper left section of FIG. 6A illustrates the voltage waveform of the source line driven to a positive drive voltage in the k-th horizontal sync period for the case when the grayscale level of the image data $D_{2i-1}$ is "127", wherein the legend "B" denotes the operation in which the source line is placed in the high impedance state. When the grayscale level of the image data $D_{2i-1}$ is "127", the most significant bit of the image data $D_{2i-1}$ is "0" and the source line to be driven to the positive drive voltage selected from the source lines $\mathbf{5}_{2i-1}$ and $\mathbf{5}_{2i}$ is placed into the high impedance state.

The lower left section of FIG. 6A illustrates the voltage waveform of the source line driven to a positive drive voltage in the k-th horizontal sync period for the case when the grayscale level of the image data $D_{2i-1}$ is "128", wherein the legend "C" denotes the operation in which the source line is precharged. When the grayscale level of the image data $D_{2i-1}$ is "128", the most significant bit of the image data $D_{2i-1}$ is "1" and the source line to be driven to the positive drive voltage selected from the source lines $\mathbf{5}_{2i-1}$ and $\mathbf{5}_{2i}$ is precharged to the voltage VCI.

Meanwhile, the control circuit $\mathbf{36}_{2i}$ turns off the precharge switch $\mathbf{35}_{2i}$ when the most significant bit of the image data $D_{2i}$ is "0" and turns on the precharge switch $\mathbf{35}_{2i}$ when the most significant bit of the image data $D_{2i}$ is "1". This results in that, as illustrated in FIG. 6B, the source line to be driven to a negative drive voltage selected from the source lines $\mathbf{5}_{2i-1}$ and $\mathbf{5}_{2i}$ is placed into the high impedance state when the most significant bit of the image data $D_{2i}$ is "0" and precharged to the voltage VCL when the most significant bit of the image data $D_{2i}$ is "1."

The upper left section of FIG. 6B illustrates the voltage waveform of the source line driven to a negative drive voltage in the k-th horizontal sync period for the case when the grayscale level of the image data $D_{2i}$ is "127." In this case, the most significant bit of the image data $D_{2i}$ is "0" and the source line to be driven to the negative drive voltage selected from the source lines $\mathbf{5}_{2i-1}$ and $\mathbf{5}_{2i}$ is placed into the high impedance state.

The lower left section of FIG. 6B illustrates the voltage waveform of the source line driven to a negative drive voltage in the k-th horizontal sync period for the case when the grayscale level of the image data $D_{2i-1}$ is "128." In this case, the most significant bit of the image data $D_{2i}$ is "1" and the source line to be driven to the negative drive voltage selected from the source lines $\mathbf{5}_{2i-1}$ and $\mathbf{5}_{2i}$ is precharged to the voltage VCL.

In the drive period, which follows the precharge period, the source lines are driven to the voltages corresponding to the grayscale levels indicated by the image data. In detail, the source line to be driven to a positive drive voltage selected from the source lines $\mathbf{5}_{2i-1}$ and $\mathbf{5}_{2i}$ is driven to the voltage corresponding to the grayscale voltage $V_{2i-1}$ (typically, the same voltage as the grayscale voltage $V_{2i-1}$) by the output circuit $\mathbf{31}_{2i-1}$, as illustrated in FIG. 6A, and the source line to be driven to a negative drive voltage selected from the source lines $\mathbf{5}_{2i-1}$ and $\mathbf{5}_{2i}$ is driven to the voltage corresponding to the grayscale voltage $V_{2i}$ (typically, the same voltage as the grayscale voltage $V_{2i}$) by the output circuit $\mathbf{31}_{2i}$, as illustrated in FIG. 6B. In FIG. 6A, the positive voltage corresponding to the grayscale level of "127" is denoted by the legend "$V_{P127}$" and the positive voltage corresponding to the grayscale level of "128" is denoted by the legend "$V_{P128}$." In FIG. 6B, the negative voltage corresponding to the grayscale level of "127" is denoted by the legend "$V_{N127}$" and the negative voltage corresponding to the grayscale level of "128" is denoted by the legend "$V_{N128}$." The drive operation is thus completed in the k-th horizontal sync period.

(2) Low Temperature Drive Operation

The right columns of FIGS. 6A and 6B are timing charts illustrating the operation of the liquid crystal display device 1 in the k-th horizontal sync period in embodiment #1 in the case that the low temperature drive operation is performed.

In embodiment #1, the precharge operation is unconditionally omitted independently of the grayscale levels indicated by the image data in the low temperature drive operation. Unconditionally omitting the precharge operation independently of the grayscale levels indicated by the image data effectively resolves the above-described problem that the actually-perceived brightness of a pixel largely varies at the grayscale level at which execution/non-execution of the precharge operation is switched.

More specifically, when the low temperature drive operation is performed, the precharge control signal $S_{PRC_CTRL}$ is negated by the control section 13. The control circuits $\mathbf{36}_{2i-1}$ and $\mathbf{36}_{2i}$ turn off the precharge switches $\mathbf{35}_{2i-1}$ and $\mathbf{35}_{2i}$ in response to the negation of the precharge control signal $S_{PRC_CTRL}$.

In the low temperature drive operation, a high-impedance period is provided between the equalization period and the drive period in place of the precharge period. In the high-impedance period, the source lines are set to the high-impedance state. More specifically, in the high-impedance period, the precharge switches $\mathbf{35}_{2i-1}$ and $\mathbf{35}_{2i}$ are turned off independently of the grayscale levels indicated by the image data, and the outputs of the output circuits $\mathbf{31}_{2i-1}$ and $\mathbf{31}_{2i}$ are placed into the high-impedance state. This results in that the source lines $\mathbf{5}_{2i-1}$ and $\mathbf{5}_{2i}$ are placed into the high-impedance state. In the right columns of FIGS. 6A and 6B, the legends "B" denote the operation in which the source lines are placed into the high-impedance state. When the source lines $\mathbf{5}_{2i-1}$ and $\mathbf{5}_{2i}$ are set to the high-impedance state, the voltages on the source lines $\mathbf{5}_{2i-1}$ and $\mathbf{5}_{2i}$ are basically kept unchanged.

The operations in the equalization period and the drive period in the low temperature drive operation are respectively the same as those in the normal drive operation. In the drive period, which follows the high-impedance period, the source lines are driven to the voltages corresponding to the grayscale levels indicated by the image data, to complete the drive operation in the k-th horizontal sync period.

As described above, the precharge operation is unconditionally omitted independently of the grayscale levels indicated by the image data in embodiment #1, when the low temperature drive operation is performed. This effectively resolves the problem that the actually-perceived brightness of a pixel largely varies at the grayscale level at which execution/non-execution of the precharge operation is switched.

Embodiment #2

Figure 7A:
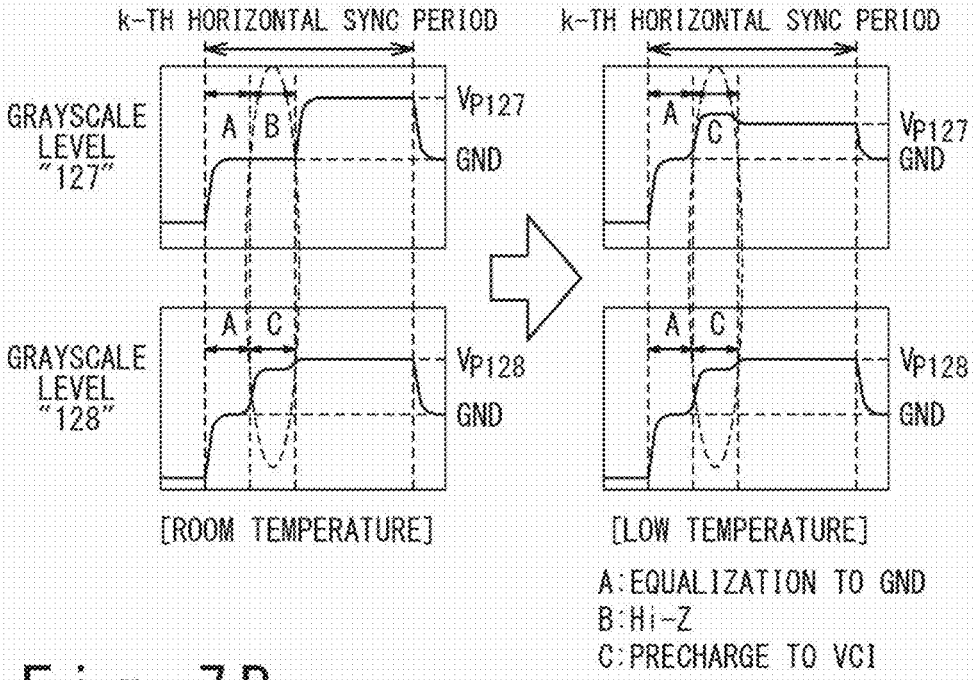
FIGS. 7A and 7B are timing charts illustrating a source line drive operation in embodiment #2.
Figure 7B:
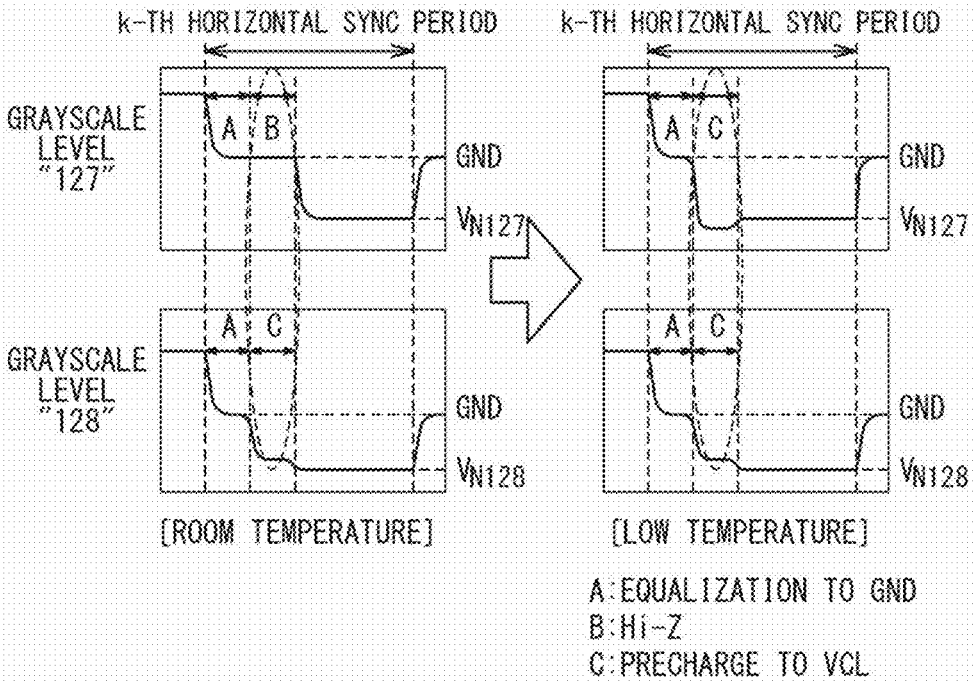

FIGS. 7A and 7B are timing charts illustrating one example of the drive operation of the source lines in the k-th horizontal sync period in embodiment #2. Note that FIG. 7A illustrates an exemplary operation in the case that a source line which has been driven to a negative voltage in the immediately previous horizontal sync period ((k−1)-th horizontal sync period) is driven to a positive voltage in the k-th horizontal sync period, and FIG. 7B illustrates an exemplary operation in the case that a source line which has been driven to a positive voltage in the immediately previous horizontal sync period ((k−1)-th horizontal sync period) is driven to a negative voltage in the k-th horizontal sync period.

Also in embodiment #2, the selection between the normal drive operation and the low temperature drive operation in response to the measured temperature by the temperature sensor 21 is performed in the same way as embodiment #1. Furthermore, the drive operation of the liquid crystal display panel 2 in the normal drive operation in embodiment #2 is the same as that in embodiment #1.

There exists, however, a difference between embodiments 1 and 2 in that the precharge operation is unconditionally performed independently of the grayscale levels indicated by the image data in the low temperature drive operation in embodiment #2. The right columns of FIGS. 7A and 7B illustrates the low temperature drive operation in embodiment #2. Unconditionally performing the precharge operation independently of the grayscale levels indicated by the image data also effectively resolves the above-described problem that the actually-perceived brightness of a pixel largely varies at the grayscale level at which execution/non-execution of the precharge operation is switched.

In the following, a detailed description is given of the low temperature drive operation in embodiment #2. The precharge control signal $S_{PRC_CTRL}$ is asserted by the control section 13 when the low temperature drive operation is performed. The control circuits $\mathbf{36}_{2i-1}$ and $\mathbf{36}_{2i}$ turn on the precharge switches $\mathbf{35}_{2i-1}$ and $\mathbf{35}_{2i}$ in the precharge period in response to the assertion of the precharge control signal $S_{PRC_CTRL}$.

When the low temperature drive operation is performed in the k-th horizontal sync period, three periods are defined in the k-th horizontal sync period: an equalization period, a precharge period and a drive period. The precharge period is defined to follow the equalization period and the drive period is defined to follow the precharge period.

In the equalization period, equalization of the source lines is performed. More specifically, the equalizing switches $\mathbf{34}_{2i-1}$ and $\mathbf{34}_{2i}$ are turned on to connect the nodes $N_{2i-1}$ and $N_{2i}$ to the circuit ground line 37, and the outputs of the output circuits $\mathbf{31}_{2i-1}$ and $\mathbf{31}_{2i}$ are placed into the high impedance (Hi-Z) state. This results in that the source lines $\mathbf{5}_{2i-1}$ and $\mathbf{5}_{2i}$ are electrically connected to the circuit ground line 37, and thereby equalized to the circuit ground level. In FIGS. 7A and 7B, the legends "A" denote the operation in which the source lines are equalized to the circuit ground level GND.

In the precharge period, which follows the equalization period, the precharge operation is unconditionally performed independently of the grayscale levels indicated by the image data. More specifically, the operation descried below is performed in the precharge period.

In response to the assertion of the precharge control signal $S_{PRC_CTRL}$ the control circuits $\mathbf{36}_{2i-1}$ and $\mathbf{36}_{2i}$ turn on the precharge switches $\mathbf{35}_{2i-1}$ and $\mathbf{35}_{2i}$. This results in that, as illustrated in the right column of FIG. 7A, the source line to be driven to a positive drive voltage selected from the source lines $\mathbf{5}_{2i-1}$ and $\mathbf{5}_{2i}$ is precharged to the voltage VCI, and as illustrated in the right column of FIG. 7B, the source line to be driven to a negative drive voltage selected from the source lines $\mathbf{5}_{2i-1}$ and $\mathbf{5}_{2i}$ is precharged to the voltage VCL.

In the drive period, which follows the precharge period, the source lines are driven to the voltages corresponding to the grayscale levels indicated by the image data. In detail, the source line to be driven to the positive drive voltage selected from the source lines $\mathbf{5}_{2i-1}$ and $\mathbf{5}_{2i}$ is driven to the voltage corresponding to the grayscale voltage $V_{2i-1}$ (typically, the same voltage as the grayscale voltage $V_{2i-1}$) by the output circuit $\mathbf{31}_{2i-1}$, as illustrated in FIG. 7A, and the source line to be driven to the negative drive voltage selected from the source lines $\mathbf{5}_{2i-1}$ and $\mathbf{5}_{2i}$ is driven to the voltage corresponding to the grayscale voltage $V_{2i}$ (typically, the same voltage as the grayscale voltage $V_{2i}$) by the output circuit $\mathbf{31}_{2i}$, as illustrated in FIG. 7B. The drive operation is thus completed in the k-th horizontal sync period.

As described above, in embodiment #2, the precharge operation is unconditionally performed independently of the grayscale levels indicated by the image data when the low temperature drive operation is performed. This effectively resolves the problem that the actually-perceived brightness of a pixel largely varies at the grayscale level at which execution/non-execution of the precharge operation is switched.

Embodiment #3

Figure 8A:
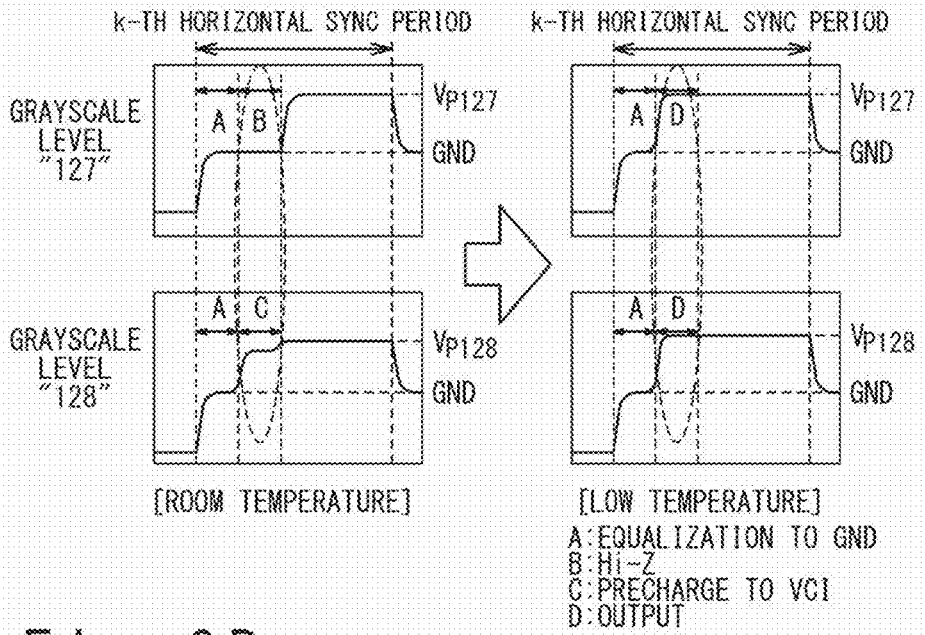
FIGS. 8A and 8B are timing charts illustrating a source line drive operation in embodiment #3.
Figure 8B:
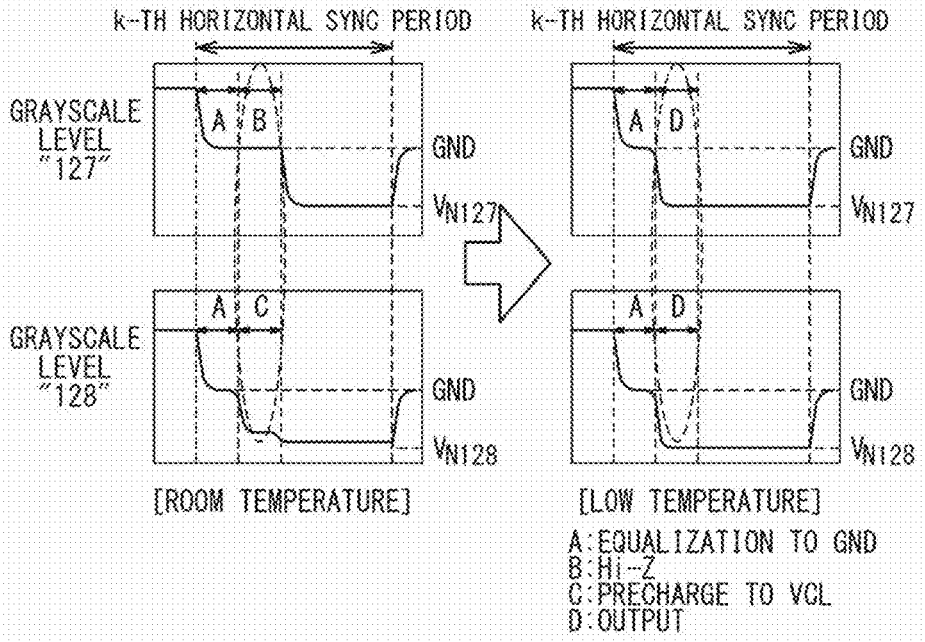

FIGS. 8A and 8B are timing charts illustrating one example of the drive operation of the source lines in the k-th horizontal sync period in embodiment #3. Note that FIG. 8A illustrates an exemplary operation in the case that a source line which has been driven to a negative voltage in the immediately previous horizontal sync period ((k−1)-th horizontal sync period) is driven to a positive voltage in the k-th horizontal sync period, and FIG. 8B illustrates an exemplary operation in the case that a source line which has been driven to a positive voltage in the immediately previous horizontal sync period ((k−1)-th horizontal sync period) is driven to a negative voltage in the k-th horizontal sync period.

Also in embodiment #3, the selection between the normal drive operation and the low temperature drive operation in response to the measured temperature by the temperature sensor 21 is performed in the same way as embodiment #1. Furthermore, the drive operation of the liquid crystal display panel 2 in the normal drive operation in embodiment #3 is the same as that in embodiment #1.

In embodiment #3, as is the case with embodiment #1, the precharge operation is unconditionally omitted independently of the grayscale levels indicated by the image data in the low temperature drive operation. It should be noted however that the high-impedance period is not provided in embodiment #3. Instead, a precedent output operation which involves precedently outputting the voltages corresponding to the grayscale levels indicated by the image data is performed in the period corresponding to the precharge period of the normal drive operation. The period in which the precedent output operation is performed is referred to as the precedent output period, hereinafter. In FIGS. 8A and 8B, the legends "D" denote the precedent drive operation. The operation of embodiment #3 also effectively resolves the above-described problem that the actually-perceived brightness of a pixel largely varies at the grayscale level at which execution/non-execution of the precharge operation is switched. Additionally, the operation of embodiment #3 lengthens the time duration during which the source lines are kept to the voltages corresponding to the grayscale levels indicated by the image data when the liquid crystal display device 1 is operated at low temperature; this effectively makes the actually-perceived brightness of each pixel of the liquid crystal display panel 2 close to the desired brightness, even if the response speed of the liquid crystal display panel 2 is decreased at low temperature.

In the following, a description is given of the low temperature drive operation in embodiment #3. When the low temperature drive operation is performed, the precharge control signal $S_{PRC_CTRL}$ is negated by the control section 13. The control circuits $\mathbf{36}_{2i-1}$ and $\mathbf{36}_{2i}$ turn off the precharge switches $\mathbf{35}_{2i-1}$ and $\mathbf{35}_{2i}$ in response to the negation of the precharge control signal $S_{PRC_CTRL}$.

When the low temperature drive operation is performed in the k-th horizontal sync period, three periods are defined in the k-th horizontal sync period: an equalization period, a precedent output period and a drive period. The precedent output period is defined to follow the equalization period and the drive period is defined to follow the precedent output period. The precedent output period is defined as a period corresponding to the precharge period in the normal drive operation.

In the equalization period, equalization of the source lines is performed. More specifically, the equalizing switches $\mathbf{34}_{2i-1}$ and $\mathbf{34}_{2i}$ are turned on to connect the nodes $N_{2i-1}$ and $N_{2i}$ to the circuit ground line 37, and the outputs of the output circuits $\mathbf{31}_{2i-1}$ and $\mathbf{31}_{2i}$ are placed into the high impedance (Hi-Z) state. This results in that the source lines $\mathbf{5}_{2i-1}$ and $\mathbf{5}_{2i}$ are electrically connected to the circuit ground line 37, and thereby equalized to the circuit ground level. In FIGS. 8A and 8B, the legends "A" denote the operation in which the source lines are equalized to the circuit ground level GND.

In the precedent output period, which follows the equalization period, the source lines are driven to the voltages corresponding to the grayscale levels indicated by the image data. In detail, the source line to be driven to a positive drive voltage selected from the source lines $\mathbf{5}_{2i-1}$ and $\mathbf{5}_{2i}$ is driven to the voltage corresponding to the grayscale voltage $V_{2i-1}$ (typically, the same voltage as the grayscale voltage $V_{2i-1}$) by the output circuit $\mathbf{31}_{2i-1}$, as illustrated in FIG. 8A, and the source line to be driven to a negative drive voltage selected from the source lines $\mathbf{5}_{2i-1}$ and $\mathbf{5}_{2i}$ is driven to the voltage corresponding to the grayscale voltage $V_{2i}$ (typically, the same voltage as the grayscale voltage $V_{2i}$) by the output circuit $\mathbf{31}_{2i}$, as illustrated in FIG. 8B.

In the drive period, the operation in which the source lines are driven to the voltages corresponding to the grayscale levels indicated by the image data is continued. The respective source lines are kept to the voltages corresponding to the grayscale levels indicated by the associated image data. The drive operation is thus completed in the k-th horizontal sync period.

In embodiment #3, as described above, the precharge operation is unconditionally omitted independently of the grayscale levels indicated by the image data in the low temperature drive operation. This effectively resolves the problem that the actually-perceived brightness of a pixel largely varies at the grayscale level at which execution/non-execution of the precharge operation is switched.

Additionally, the operation in embodiment #3 effectively addresses the reduction in the response speed of the liquid crystal display panel 2 at the low temperature, since the low temperature drive operation involves precedently outputting the voltages corresponding to the grayscale levels indicated by the image data in the period corresponding to the precharge period defined in the normal drive operation.

Embodiment #4

Figure 9A:
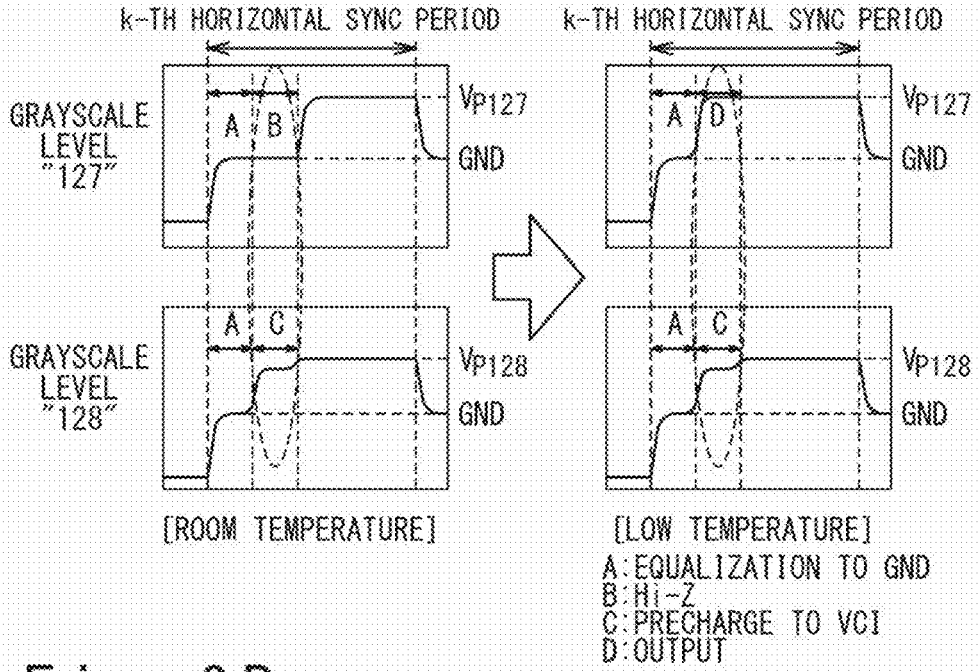
FIGS. 9A and 9B are timing charts illustrating a source line drive operation in embodiment #4.
Figure 9B:
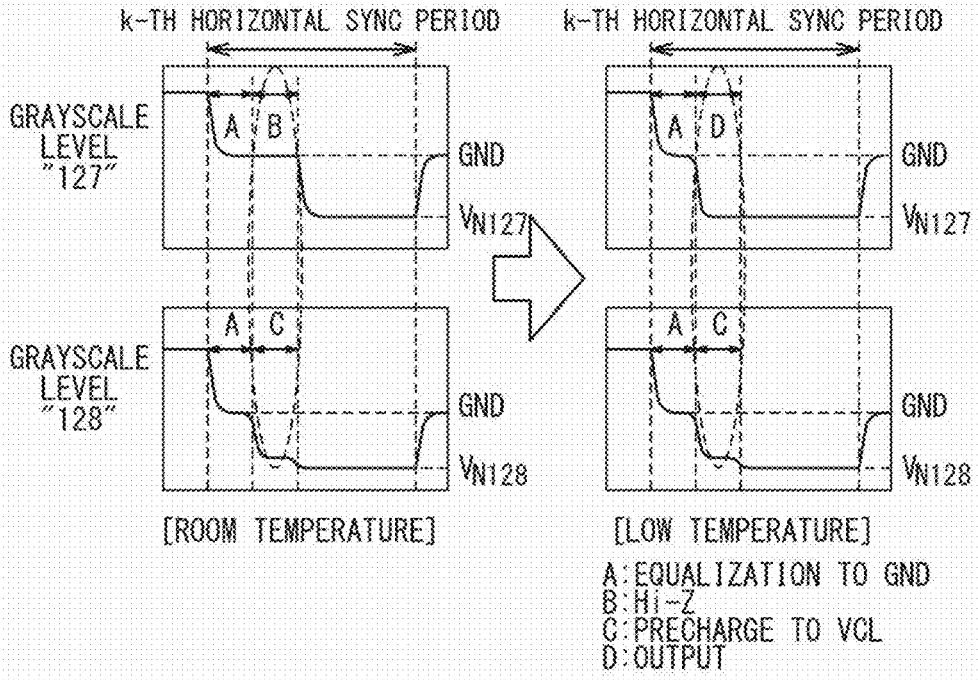

FIGS. 9A and 9B are timing charts illustrating one example of the source line drive operation in the k-th horizontal sync period in embodiment #4. Note that FIG. 9A illustrates an exemplary operation in the case that a source line which has been driven to a negative voltage in the immediately previous horizontal sync period ((k−1)-th horizontal sync period) is driven to a positive voltage in the k-th horizontal sync period, and FIG. 9B illustrates an exemplary operation in the case that a source line which has been driven to a positive voltage in the immediately previous horizontal sync period ((k−1)-th horizontal sync period) is driven to a negative voltage in the k-th horizontal sync period.

Also in embodiment #4, the selection between the normal drive operation and the low temperature drive operation in response to the measured temperature by the temperature sensor 21 is performed in the same way as embodiment #1. Furthermore, the drive operation of the liquid crystal display panel 2 in the normal drive operation in embodiment #4 is the same as that in embodiment #1.

In embodiment #4, one of the precharge operation and the precedent output operation is selectively preformed for each source line in response to the grayscale level indicated by the corresponding image data in the low temperature drive operation. As described above, the precedent output operation involves precedently outputting the voltages corresponding to the grayscale levels indicated by the image data. In FIGS. 9A and 9B, the legends "D" denote the precedent drive operation. At the grayscale level at which execution/non-execution of the precharge operation is switched, the voltage waveform on a source line in the case that the precharge operation is performed is not the same but similar to the voltage waveform on the source line in the case that the precedent output operation is performed. Accordingly, the above-described operation in embodiment #4 also effectively resolves the above-described problem that the actually-perceived brightness of a pixel largely varies at the grayscale level at which execution/non-execution of the precharge operation is switched.

In the following, a description is given of the low temperature drive operation in embodiment #4.

In embodiment #4, the precharge control signal $S_{PRC_CTRL}$ is asserted by the control section 13 also when the low temperature drive operation is performed. When the precharge control signal $S_{PRC_CTRL}$ is asserted, the control circuit $\mathbf{36}_{2i-1}$ is placed into the state in which the control circuit $\mathbf{36}_{2i-1}$ controls the precharge switch $\mathbf{35}_{2i-1}$ in response to the most significant bit $D_{MSB(2i-1)}$ of the image data $D_{2i-1}$, and the control circuit $\mathbf{36}_{2i}$ is placed into the state in which the control circuit $\mathbf{36}_{2i}$ controls the precharge switch $\mathbf{35}_{2i}$ in response to the most significant bit $D_{MSB(2i)}$ of the image data $D_{2i}$.

When the low temperature drive operation is performed in the k-th horizontal sync period, three periods are defined in the k-th horizontal sync period: an equalization period, a precharge period and a drive period. The precharge period is defined to follow the equalization period and the drive period is defined to follow the precharge period.

In the equalization period, equalization of the source lines is performed. More specifically, the equalizing switches $\mathbf{34}_{2i-1}$ and $\mathbf{34}_{2i}$ are turned on to connect the nodes $N_{2i-1}$ and $N_{2i}$ to the circuit ground line 37, and the outputs of the output circuits $\mathbf{31}_{2i-1}$ and $\mathbf{31}_{2i}$ are placed into the high impedance (Hi-Z) state. This results in that the source lines $\mathbf{5}_{2i-1}$ and $\mathbf{5}_{2i}$ are electrically connected to the circuit ground line 37, and thereby equalized to the circuit ground level. In FIGS. 9A and 9B, the legends "A" denote the operation in which the source lines are equalized to the circuit ground level GND.

In the precharge period, which follows the equalization period, one of the precharge operation and the precedent output operation selected in response to the grayscale level indicated by the image data, more particularly, the most significant bit of the image data is performed. The following is a detailed description of the operation performed in the precharge period.

The control circuit $\mathbf{36}_{2i-1}$ turns off the precharge switch $\mathbf{35}_{2i-1}$ when the most significant bit of the image data $D_{2i-1}$ is "0", whereas the control circuit $\mathbf{36}_{2i-1}$ turns on the precharge switch $\mathbf{35}_{2i-1}$ when the most significant bit of the image data $D_{2i-1}$ is "1." The output circuit $\mathbf{31}_{2i-1}$ outputs the voltage corresponding to the grayscale voltage $V_{2i-1}$ (typically, the same voltage as the grayscale voltage $V_{2i-1}$) when the most significant bit of the image data $D_{2i-1}$ is "0", whereas the output circuit $\mathbf{31}_{2i-1}$ sets the output thereof to the high-impedance state when the most significant bit of the image data $D_{2i-1}$ is "1."

As illustrated in FIG. 9A, this results in that the source line to be driven to a positive drive voltage selected from the source lines $\mathbf{5}_{2i-1}$ and $\mathbf{5}_{2i}$ is driven to the voltage corresponding to the grayscale level indicated by the image data $D_{2i-1}$ when the most significant bit of the image data $D_{2i-1}$ is "0", and precharged to the voltage VCI when the most significant bit of the image data $D_{2i-1}$ is "1."

The upper right section of FIG. 9A illustrates the voltage waveform on the source line driven to a positive drive voltage for the case that the grayscale level indicated by the image data $D_{2i-1}$ is "127." The legend "D" in FIG. 9A denotes the precedent output operation. When the grayscale level indicated by the image data $D_{2i-1}$ is "127", the most significant bit of the image data $D_{2i-1}$ is "0" and the source line to be driven to the positive drive voltage selected from the source lines $\mathbf{5}_{2i-1}$ and $\mathbf{5}_{2i}$ is driven to the voltage $V_{P127}$, which corresponds to the grayscale level indicated by the image data $D_{2i-1}$.

The lower right section of FIG. 9A illustrates the voltage waveform on the source line driven to a positive drive voltage for the case that the grayscale level indicated by the image data $D_{2i-1}$ is "128." The legend "C" in FIG. 9A denotes the precharge operation of the source line. When the grayscale level indicated by the image data $D_{2i-1}$ is "128", the most significant bit of the image data $D_{2i-1}$ is "1" and the source line driven to the positive drive voltage selected from the source lines $\mathbf{5}_{2i-1}$ and $\mathbf{5}_{2i}$ is precharged to the voltage VCI.

Meanwhile, the control circuit $\mathbf{36}_{2i}$ turns off the precharge switch $\mathbf{35}_{2i}$ when the most significant bit of the image data $D_{2i}$ is "0", whereas the control circuit $\mathbf{36}_{2i}$ turns on the precharge switch $\mathbf{35}_{2i}$ when the most significant bit of the image data $D_{2i}$ is "1." The output circuit $\mathbf{31}_{2i}$ outputs the voltage corresponding to the grayscale voltage $V_{2i}$ (typically, the same voltage as the grayscale voltage $V_{2i}$) when the most significant bit of the image data $D_{2i}$ is "0", whereas the output circuit $\mathbf{31}_{2i}$ sets the output thereof to the high-impedance state when the most significant bit of the image data $D_{2i}$ is "1."

As illustrated in FIG. 9B, this results in that the source line to be driven to a negative drive voltage selected from the source lines $\mathbf{5}_{2i-1}$ and $\mathbf{5}_{2i}$ is driven to the voltage corresponding to the grayscale level indicated by the image data $D_{2i}$ when the most significant bit of the image data $D_{2i}$ is "0", and precharged to the voltage VCL when the most significant bit of the image data $D_{2i}$ is "1."

The upper right section of FIG. 9B illustrates the voltage waveform on the source line driven to a negative drive voltage for the case that the grayscale level indicated by the image data $D_{2i}$ is "127." When the grayscale level indicated by the image data $D_{2i}$ is "127", the most significant bit of the image data $D_{2i}$ is "0" and the source line to be driven to the negative drive voltage selected from the source lines $\mathbf{5}_{2i-1}$ and $\mathbf{5}_{2i}$ is driven to the voltage $V_{N127}$, which corresponds to the grayscale level indicated by the image data $D_{2i}$.

The lower right section of FIG. 9B illustrates the voltage waveform on the source line driven to a negative drive voltage for the case that the grayscale level indicated by the image data $D_{2i}$ is "128." In this case, the most significant bit of the image data $D_{2i}$ is "1" and the source line driven to the negative drive voltage selected from the source lines $\mathbf{5}_{2i-1}$ and $\mathbf{5}_{2i}$ is precharged to the voltage VCL.

In the drive period, which follows the precharge period, the source lines are driven to the voltages corresponding to the grayscale levels indicated by the image data. In detail, the source line to be driven to the positive drive voltage selected from the source lines $\mathbf{5}_{2i-1}$ and $\mathbf{5}_{2i}$ is driven to the voltage corresponding to the grayscale voltage $V_{2i-1}$ (typically, the same voltage as the grayscale voltage $V_{2i-1}$) by the output circuit $\mathbf{31}_{2i-1}$, as illustrated in FIG. 9A, and the source line to be driven to the negative drive voltage selected from the source lines $\mathbf{5}_{2i-1}$ and $\mathbf{5}_{2i}$ is driven to the voltage corresponding to the grayscale voltage $V_{2i}$ (typically, the same voltage as the grayscale voltage $V_{2i}$) by the output circuit $\mathbf{31}_{2i}$, as illustrated in FIG. 9B. The drive operation is thus completed in the k-th horizontal sync period.

As described above, in the low temperature drive operation in embodiment #4, a selected one of the precharge operation and the precedent output operation is performed in response to the grayscale level indicated by the image data, more particularly, to the most significant bit of the image data. This effectively relieves the problem that the actually-perceived brightness of a pixel largely varies at the grayscale level at which execution/non-execution of the precharge operation is switched.

Although the configuration in which the temperature sensor 21 is integrated in the display driver 3 is depicted in the above-described embodiments, a person skilled would understand that the temperature sensor 21 may be provided at any desired position in the liquid crystal display device 1. In one embodiment, the temperature sensor 21 may be coupled with the liquid crystal display panel 2. Also in this case, execution/non-execution of the precharge operation is selected in response to the measured temperature by the temperature sensor 21.

Although specific embodiments of the present invention have been described above, the present invention should not be construed as being limited to the above-described embodiments; it would be apparent to a person skilled in the art that the present invention may be implemented with various modifications.

What is claimed is:

1. A driver adapted to drive a source line of a liquid crystal display panel, comprising:

a temperature sensor;

drive circuitry configured to drive the source line in response to image data;

precharge circuitry configured to perform a precharge operation of the source line; and equalization circuitry configured to perform an equalization operation in which the source line is electrically connected to another source line of the liquid crystal display panel, wherein, when a temperature measured by the temperature sensor is in a first temperature range, the equalization circuitry is configured to perform the equalization operation in a first period of each horizontal sync period, the precharge circuitry is configured to perform the precharge operation of the source line in response to a grayscale level in a second period of each horizontal sync period, and the drive circuitry is configured to drive the source line to a voltage corresponding to a grayscale level in a third period of each horizontal sync period.

2. The driver according to claim 1, wherein, when the measured temperature is in a second temperature range, the equalization circuitry is configured to perform the equalization operation in the first period of each horizontal sync period, wherein one of first and second operations selected in response to the grayscale level is performed in the second period of each horizontal sync period, and the drive circuitry is configured to drive the source line to the voltage corresponding to the grayscale level in the third period of each horizontal sync period, wherein, in the first operation, the precharge circuitry performs the precharge operation, and wherein, in the second operation, the drive circuitry drives the source line to the voltage corresponding to the grayscale level in the third period of each horizontal sync period.

3. The driver according to claim 2, wherein, when the measured temperature is in the second temperature range, selection of the first and second operations is responsive to a most significant bit of the image data.

4. A liquid crystal display device, comprising:

a liquid crystal display panel including a source line;

a driver; and a temperature sensor, wherein the driver includes:

drive circuitry configured to drive the source line to a voltage corresponding to a grayscale level indicated by image data;

precharge circuitry configured to perform a precharge operation of the source line; and equalization circuitry configured to perform an equalization operation in which the source line is electrically connected to another source line of the liquid crystal display panel, wherein, when a temperature measured by the temperature sensor is in a first temperature range, the equalization circuitry is configured to perform the equalization operation in a first period of each horizontal sync period, the precharqe circuitry is configured to perform the precharge operation of the source line in response to the qrayscale level in a second period of each horizontal sync period, and the drive circuitry is configured to drive the source line to the voltage corresponding to the grayscale level in a third period of each horizontal sync period.

5. The liquid crystal display device of claim 4, wherein, when the measured temperature is in a second temperature range, the equalization circuitry is configured to perform the equalization operation in the first period of each horizontal sync period, wherein one of first and second operations selected in response to the grayscale level is performed in the second period of each horizontal sync period, and the drive circuitry is configured to drive the source line to the voltage corresponding to the grayscale level in the third period of each horizontal sync period, wherein, in the first operation, the precharge circuitry is configured to perform the precharge operation, and wherein, in the second operation, the drive circuitry is configured to drive the source line to the voltage corresponding to the grayscale level.

6. A method for driving a liquid crystal display panel of a liquid crystal display device including a temperature sensor, the method comprising:

performing an equalization operation in which a first source line is electrically connected to a second source line of the liquid crystal display panel, in a first period of each horizontal sync period;

selectively performing one of first and second operations in response to a temperature measured by the temperature sensor in a second period of each horizontal sync period; and driving the first source line to a voltage corresponding to a grayscale level indicated by image data in at least one of the second period of each horizontal sync period and a third period of each horizontal sync period, wherein the first operation includes performing a precharge operation of the first source line by precharge circuitry in response to the grayscale level indicated by the image data, wherein the second operation includes driving the first source line to the voltage corresponding to the grayscale level indicated by the image data.

7. The method of claim 6, wherein, when the measured temperature is in a first temperature range, the precharge operation of the first source line is performed in response to the grayscale level when the measured temperature in the second period of each horizontal sync period.

8. The method of claim 6, wherein, when the measured temperature is in a second temperature range lower than a first temperature range, one of the first and second operations selected in response to the grayscale level is performed in the second period of each horizontal sync period.

* * * * *